United States Patent [19]

Wibben

[11] 4,048,924

[45] Sept. 20, 1977

[54] ROOFING SYSTEM

[76] Inventor: Warren G. Wibben, 479 N. State St., Apt. B-1, Concord, N.H. 03301

[21] Appl. No.: 648,529

[22] Filed: Jan. 12, 1976

Related U.S. Application Data

[63] Continuation-in-part of Ser. No. 542,121, Jan. 20, 1975, abandoned.

[51] Int. Cl.[2] ..... E04E 3/02; E04D 15/07

[52] U.S. Cl. ..... 104/245; 104/1 R; 182/38; 182/45

[58] Field of Search ..... 104/1 R, 110, 118, 119, 104/121, 124, 242, 243, 245-247; 212/14; 214/16 R, 16 B; 182/36-39, 45; 52/29, 30, 747, 748

[56] References Cited

U.S. PATENT DOCUMENTS

| | | | |
|---|---|---|---|
| 206,416 | 7/1878 | Bowman | 104/119 |
| 463,106 | 11/1891 | Dees | 182/45 X |
| 710,281 | 9/1902 | Leek | 182/38 |
| 1,016,935 | 2/1912 | Clark | 182/45 X |
| 1,160,721 | 11/1915 | Kessler | 182/38 |
| 1,214,094 | 1/1917 | Thompson | 104/245 |
| 1,825,468 | 9/1931 | Miller | 104/247 |
| 2,814,533 | 11/1957 | Van Horn | 182/37 X |

*Primary Examiner*—Evon C. Blunk
*Assistant Examiner*—Andres Kashnikow
*Attorney, Agent, or Firm*—Jerry Cohen; Charles Hieken

[57] ABSTRACT

Packets of long metal roofing panels are transported on the skeletal structure of a pitched roof by a carrier structure with an elongated skeletal frame spanning the purlins which run the length of the pitched roof. The carrier structure comprises wheel structure on each of several adjacent purlins, with each such wheel structure comprising multiple sets of pairs of a horizontal axis wheel and a vertical axis wheel.

2 Claims, 3 Drawing Figures

ROOFING SYSTEM

CROSS REFERENCE TO RELATED APPLICATIONS

This application is a continuation-in-part of application Ser. No. 542,121, filed Jan. 20, 1975 and now abandoned.

BACKGROUND OF THE INVENTION

The present invention relates to construction of metal buildings and more particularly to placing metal panels on the roof of such a building in a short time and with greater safety to roofing personnel.

Metal buildings are used for storage, industry and increasingly for residential purposes. These buildings often comprise a metal form of post and beam construction with rafters defining a pitched roof skeleton. Purlins of Z-form cross section are placed over the rafters and run the length of the building. The top bars of the purlins provide a base for supporting roofing panels which are elongated metal sheets running perpendicular to the direction of elongation of the purlins. Large packs of metal panels, typically comprising 20–30 sheets in a pack, are lifted onto a roof by a crane and roofing laborers carry one sheet at a time along the length of the roof to set down in a series array. In high winds, the panels can act as sails with danger of loss of panels and injury to personnel. Even in the absence of wind, it is difficult to maintain safe footing while walking along outer most purlins at the ridge and gutter extremities of a pitched roof while carrying a panel. Efforts in the art to provide safety straps or harnesses for workers have been too cumbersome and have failed to solve the safety problem.

It is an important object of the present invention to provide a safe roofing system.

It is a further object of the invention to provide greater speed, and consequently lower labor costs in connection with roofing metal buildings consistent with the foregoing object.

It is a further object of the invention to reliably transport a large number of roofing panels on the length of a building frame without binding or track jumping consistent with one or more of the preceding objects.

It is a further object of the invention to achieve the foregoing objects while simultaneously straightening out curves and misalignments in the purlins of the roofing structure.

SUMMARY OF THE INVENTION

According to the invention, a metal panel carriage is provided on top of the purlins of a building frame. The carriage comprises an elongated skeletal structure extending orthognal to the purlins and spaced wheel means riding on the purlins and carrying the frame. The skeletal structure extends over a length at least half the length of the roofing panels to be emplaced and such roofing panels generally extend for the full lateral extent from ridge end to gutter end of the roof. Each of these wheel means comprises a cross bar (ladder rung) with a wheel supporting frame at each end which is demountably changed into the carriage structure. The wheel supporting frame carries a vertical shaft and a horizontal shaft with a wheel mounted on each shaft. The horizontal axis wheel rides on the top bar of each Z-shaped purlin and the vertical axis wheel bears against the top free edge of such bar to prevent the carriage from track-jumping and also to use the weights carried on the carriage structure to straighten out curves in the purlins.

There are wheel means as described above riding on each of several adjacent purlins, preferably on at least half the purlins spanned by the carriage structure, and more preferably on all of them.

A packet of metal roofing panels is placed on the carriage structure at one end of the purlins and the carriage structure is wheeled along the length of the purlins unloading one metal plate from the packet at a time to form a series of array of metal panels along the length of the purlins until the roof is completed. The roofing is bolted to the purlins in conventional manner. Throughout the roofing task, the workers need not carry any metal panel more than a few feet and need not raise any panels up into the wind.

Numerous other objects, features and advantages of the invention will be apparent from the following detailed description with reference therein to the accompanying drawing in which:

DETAILED DESCRIPTION OF PREFERRED EMBODIMENTS

Figure 1:
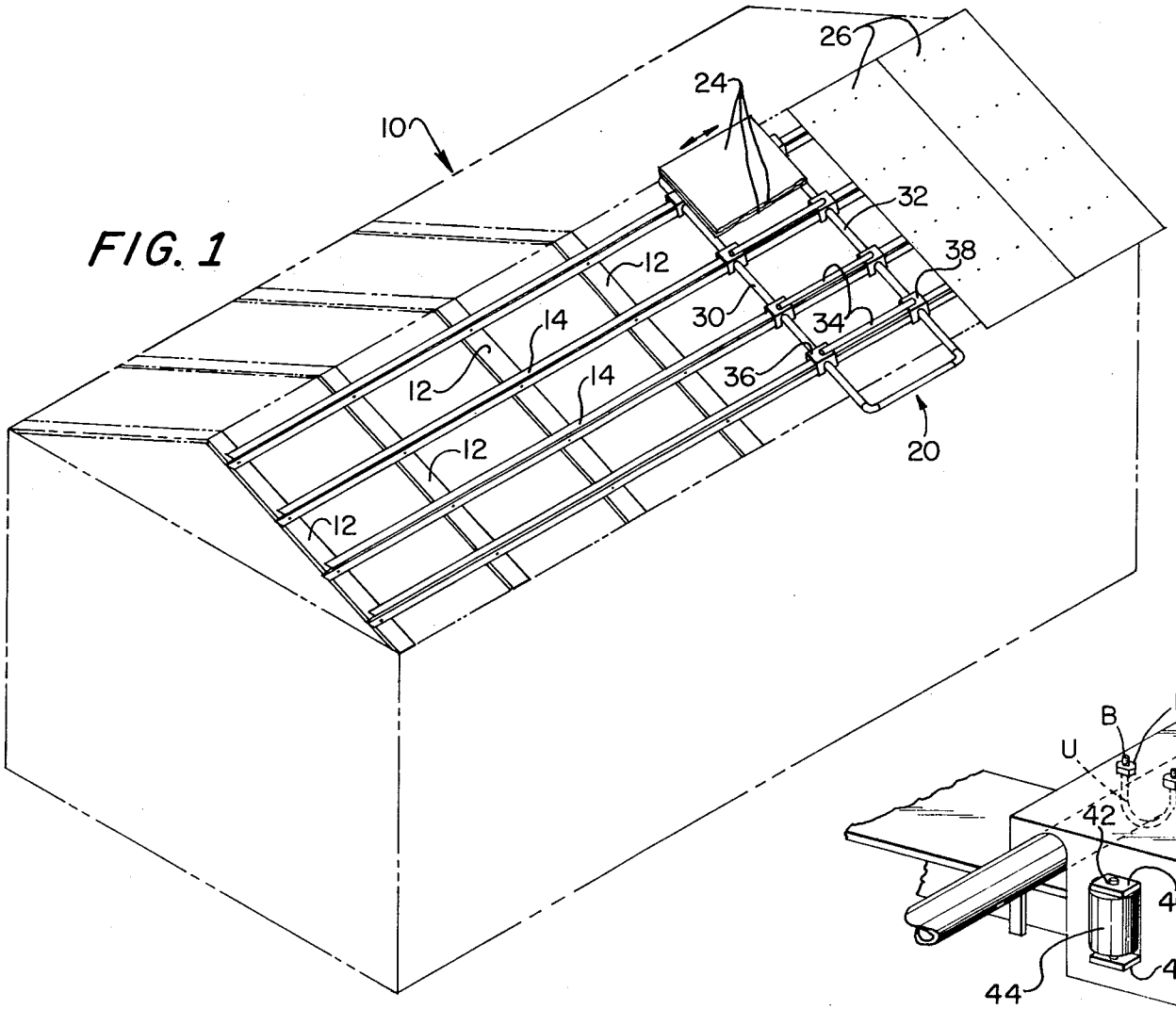
FIG. 1 is an isometric view of a building with the roofing system in accordance with the present invention thereon.

Referring now to FIG. 1, there is shown a skeletal frame 10 of a building comprising rafters 12 and purlins 14 thereon running the length of the building to define a pitch roof form. The purlins are of Z-shaped cross section and have a top bar 18 facing inwardly toward the ridge and are preferably horizontal.

Figure 2:
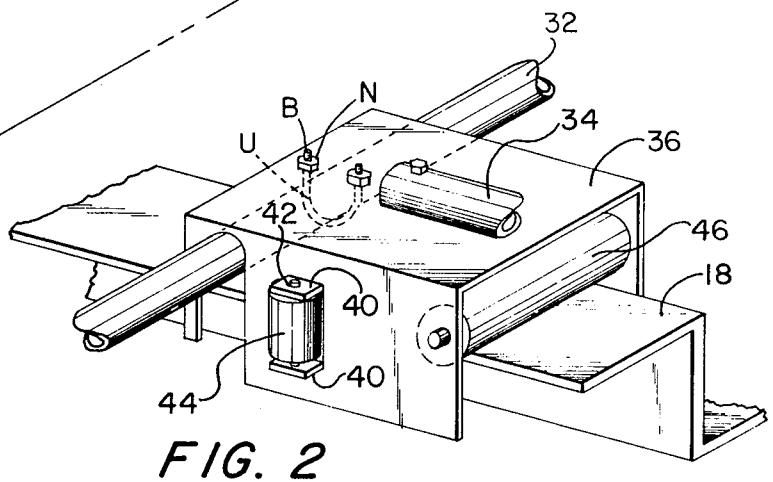
FIG. 2 is an isometric view of the wheel means component of the FIG. 1 apparatus.

A carriage 20 carries a packet of roofing panels 24 and several additional panels 26 have already been placed on the roof. The carriage structure is of pipe frame ladder form and comprises two long lengths of pipe 30 and 32 and cross bars 34 and wheel means 36 and 38 at the ends of each cross bar. The wheel means 36 and 38 are mirror-image arrangements of each other and one of these, 36 is described in further detail now with reference to FIGS. 1a and 2 together.

The wheel supporting frame 36 is of bent and pierced metal pipe construction, comprising a single metal plate which is bent into a right angle with bent ears 40 extending outwardly therefrom to provide shaft supports through holes 42 in the ears for a vertical shaft 44 and a horizontal shaft 46. The U-clamping member for holding 36 demountably to (e.g.) pipe 32 is indicated at U and it terminates in both ends B each of which receives a nut N. The nuts can be loosened at both ends to allow shifting 36 along the length of 32 and it can be removed entirely to allow complete removal, i.e., demounting.

Figure 3:
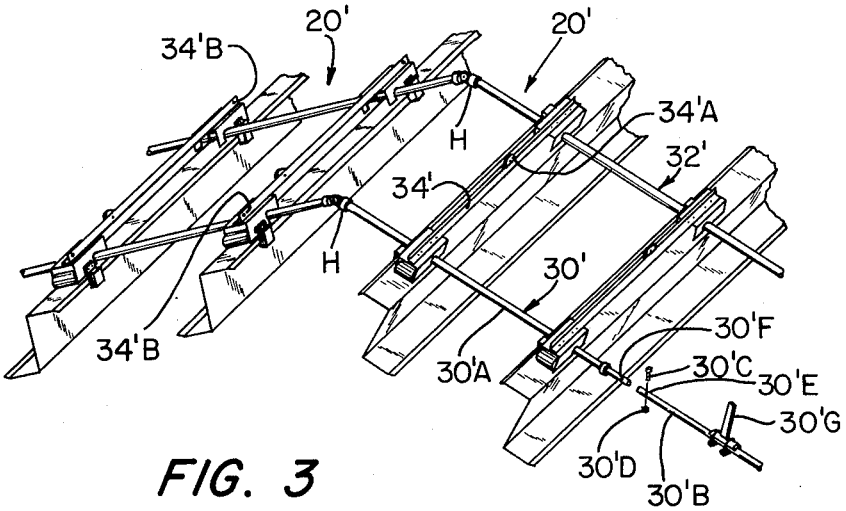
FIG. 3 is an isometric view of the FIG. 1 apparatus in two sections on opposite sides of the peaked roof and also showing some modifications of the apparatus.

FIG. 3 is a further isometric view showing two carriage structures 20' which differ from the carriage structure 20 of FIG. 1 in that two such structures are applied on opposite sides of peaked roof and linked together at hook H and in further respects described below. The hooks H comprise ball and socket ball-bearing structures with the sockets bolted together at ear tab extensions thereof. The carriages 20' comprise pipes 30' and 32' which differ from the corresponding pipes 30 and 32 of FIG. 1 in that the former are assemblages of a transition piece (e.g. for 30') 30'A and end pipe 30'B of a length adjustably to the roof width to be accomodated, linked by a bolt 30'C (with a bolt head or just a nut used with a bolt head) and a nut 30'D, the bolt passing through aligned holes 30'E and 30'F in the pieces 30'B and 30'A respectively. The piping 30'B may be one piece or multi piece. A stopping piece 30'G is provided at the end of pipe 30'B to prevent sheets from sliding down and off the roof. The carriage cross pieces 34' are channel pieces (compared to the tubing 34 of carriage 20 at FIG. 1) and have alignment tabs 34'A bolted thereon. Holes 34'B are provided at each end of channels 34'A to attach hold down straps for preventing panel blow away during nights or other extended periods when the panels are left on the roof unattended.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims. 9n

What is claimed is:

1. Roofing apparatus for handling roofing panels over purlins having tops and top free edges running the length of a pitched roof for supporting the lengths of panels in a slope direction of roof pitch comprising, means defining a carriage structure with an elongated skeletal frame extending orthogonal to the purlins and spaced wheel means riding on each of several adjacent purlins and carrying the skeletal frame, the carriage structure extending over a length of at least half the length of the roofing panels to be emplaced, each of the wheel means comprising at least first and second wheels with said first wheel having an essentially horizontal axis and said second wheel having an essentially vertical axis, the first wheel riding on top of a purlin and the vertical axis second wheel being arranged to bear against the top free edge of a purlin, at least one such wheel wheel being provided for each of several adjacent purlins of the roofing, and wherein the carriage structure is of ladder form and comprises at least two of said wheel means at each rung of the ladder, and wherein each said wheel means comprises a wheel supporting frame demountably clamped onto said carriage structure, and wherein each wheel supporting frame comprises an inverted U-form straddling the top of a purlin and holes in opposing legs of the U-form define said horizontal axis while opposing bent out ears in one of said legs with holes therein define said vertical axis, the U-form wheel supporting frame having cutouts in opposing U-legs for fitting closely over a ladder leg, and further comprising, means for demountably securing the wheel supporting frame to the ladder leg and means for securing a ladder rung end to the wheel supporting frame.

2. Roofing apparatus for handling roofing panels over purlins having tops and top free edges running the length of a pitched roof for supporting the lengths of panels in a slope direction of roof pitch comprising, means defining a carriage structure with an elongated skeletal frame extending orthogonal to the purlins and spaced wheel means riding on each of several adjacent purlins and carrying the skeletal frame, the carriage structure extending over a length of at least half the width of the pitched roof on which panels are to be emplaced, each of the wheel means comprising at least first and second wheels with said first wheel having an essentially horizontal axis and said second wheel having an essentially vertical axis, the first wheel riding on top of a purlin and the vertical axis second wheel being arranged to bear against the top free edge of a purlin, at least one such wheel means being provided for each of several adjacent purlins of the roofing, and wherein the carriage structure is of ladder form and comprises at least two of said wheel means at each rung of the ladder, and wherein each said wheel means comprises a wheel supporting frame demountably clamped onto said carriage structure, the wheel supporting frame being of bent and pierced metal plate construction, and wherein each wheel supporting frame comprises an inverted U-form straddling the top of a purlin and holes in opposing legs of the U-form define said horizontal axis while opposing bent out ears in one of said legs with holes therein define said vertical axis, the U-form wheel supporting frame having cutouts in opposing U-legs for fitting closely over a ladder leg, and further comprising, means for demountably securing the wheel supporting frame to the ladder leg and means for securing a ladder rung end to the wheel supporting frame.

* * * * *